US011557425B2

(12) United States Patent
Nishikawa et al.

(10) Patent No.: US 11,557,425 B2
(45) Date of Patent: Jan. 17, 2023

(54) COIL COMPONENT

(71) Applicant: TDK CORPORATION, Tokyo (JP)

(72) Inventors: Tomonaga Nishikawa, Tokyo (JP); Takeshi Okumura, Tokyo (JP); Kouji Kawamura, Tokyo (JP); Hidenori Tsutsui, Tokyo (JP)

(73) Assignee: TDK CORPORATION, Tokyo (JP)

( * ) Notice: Subject to any disclaimer, the term of this patent is extended or adjusted under 35 U.S.C. 154(b) by 404 days.

(21) Appl. No.: 16/816,610

(22) Filed: Mar. 12, 2020

(65) Prior Publication Data

US 2020/0294711 A1 Sep. 17, 2020

(30) Foreign Application Priority Data

Mar. 15, 2019 (JP) ..... JP2019-048009

(51) Int. Cl.

| | |
|---|---|
| ***H01F 27/29*** | (2006.01) |
| ***H01F 27/02*** | (2006.01) |
| ***H01F 17/04*** | (2006.01) |
| ***H01F 17/00*** | (2006.01) |
| ***H01F 41/04*** | (2006.01) |

(52) U.S. Cl.

CPC ..... *H01F 27/292* (2013.01); *H01F 17/0013* (2013.01); *H01F 17/04* (2013.01); *H01F 27/027* (2013.01); *H01F 41/04* (2013.01); *H01F 2017/048* (2013.01)

(58) Field of Classification Search

CPC .. H01F 27/292; H01F 27/027; H01F 17/0013; H01F 17/04; H01F 41/04; H01F 2017/048

See application file for complete search history.

(56) References Cited

U.S. PATENT DOCUMENTS

| | | | | |
|---|---|---|---|---|
| 2016/0126918 | A1* | 5/2016 | Ahn | H03H 1/0007 333/185 |
| 2016/0155557 | A1* | 6/2016 | Park | H01F 17/0013 336/83 |
| 2017/0093997 | A1 | 4/2017 | Hamada et al. | |
| 2018/0090260 | A1* | 3/2018 | Ishida | H01F 27/2804 |
| 2018/0122548 | A1* | 5/2018 | Kim | H01F 5/06 |
| 2018/0323003 | A1* | 11/2018 | Fujii | H01F 27/2804 |

FOREIGN PATENT DOCUMENTS

| | | |
|---|---|---|
| JP | 2002-151331 A | 5/2002 |
| JP | 2017076735 A | 4/2017 |

* cited by examiner

*Primary Examiner* — Hoa C Nguyen

(74) *Attorney, Agent, or Firm* — Young Law Firm, P.C.

(57) ABSTRACT

Disclosed herein is a coil component that includes an element body having first and second magnetic layers and a coil part positioned therebetween, and first and second external terminals formed on the element body. The first external terminal is formed on the mounting surface and the first side surface. The second external terminal is formed on the mounting surface and the second side surface. The first and second external terminals formed on the first and second side surfaces, respectively, have a meander shape.

12 Claims, 16 Drawing Sheets

COIL COMPONENT

BACKGROUND OF THE INVENTION

Field of the Invention

The present invention relates to a coil component and, more particularly, to a chip-type coil component having a structure in which a plurality of conductor layers and a plurality of interlayer insulating layers are alternately laminated.

Description of Related Art

As a chip-type coil component having a structure in which a plurality of conductor layers and a plurality of interlayer insulating layers are alternately laminated, a coil component described in JP 2017-76735 A is known. Unlike common laminated coil components, the coil component described in JP 2017-76735 A is vertically mounted such that the lamination direction thereof is parallel to a printed circuit board. With this configuration, even when the diameter of a coil conductor pattern incorporated in the coil component is increased, an increase in a mounting area on the printed circuit board is suppressed, which is advantageous for high-density mounting.

However, it is hard to reduce the height of the coil component described in JP 2017-76735 A, which is vertically mounted. Therefore, the coil component described in JP 2017-76735 A is not always suitable for applications in which the height reduction is prioritized over a reduction in a mounting area on the printed circuit board. In such applications, a coil component of a type that is mounted in a laid-down posture such that the lamination direction thereof is perpendicular to the printed circuit board is advantageous.

The mounting area on the printed circuit board includes an area occupied by a solder for connecting the printed circuit board and a coil component in addition to the area of the coil component itself. Therefore, in applications requiring a reduction in both the mounting area and height, it is necessary to consider the shape and structure of an external terminal provided on the surface of the coil component so as to reduce the occupation area of the solder.

As the coil component is reduced in size, inductance thereof is reduced. Thus, in order to ensure necessary inductance, it is preferable not only to sandwich, in the lamination direction, a coil conductor pattern by two magnetic layers but also to form a closed magnetic path by disposing a magnetic member also in an inner diameter part of the coil conductor pattern and a peripheral area thereof as viewed in the lamination direction.

However, when a magnetic member is disposed in the peripheral area of the coil conductor pattern, the chip size correspondingly increases, so that in a coil component of a type that is mounted in a laid-down posture such that the lamination direction thereof is perpendicular to the printed circuit board, the mounting area on the printed circuit board is disadvantageously further increased.

SUMMARY

It is therefore an object of the present invention to provide an improved coil component suitable for height reduction and having a reduced mounting area on the printed circuit board.

A coil component according to the present invention includes: an element body having first and second magnetic layers and a coil part positioned between the first and second magnetic layers and having a plurality of conductor layers and a plurality of interlayer insulating layers which are alternately laminated in the lamination direction of the coil component; and first and second external terminals formed on the surface of the element body. The element body has a mounting surface perpendicular to the lamination direction and first and second side surfaces which are parallel to the lamination direction and are opposed to each other. The first external terminal is formed on the mounting surface and the first side surface, and the second external terminal is formed on the mounting surface and the second side surface. The plurality of conductor layers each have a coil conductor pattern, a first electrode pattern exposed to the first side surface, and a second electrode pattern exposed to the second side surface. The first electrode patterns included in the plurality of respective conductor layers are connected to each other through a plurality of first via conductors which are formed so as to penetrate the plurality of interlayer insulating layers, and the second electrode patterns included in the plurality of respective conductor layers are connected to each other through a plurality of second via conductors which are formed so as to penetrate the plurality of interlayer insulating layers. At least one of the plurality of interlayer insulating layers is exposed to the first side surface at a part thereof positioned between the adjacent first electrode patterns, and at least one of the plurality of interlayer insulating layers is exposed to the second side surface at a part thereof positioned between the adjacent second electrode patterns. A part of the first external terminal that is formed on the first side surface is formed on the surfaces of the plurality of respective first electrode patterns exposed to the first side surface so as to avoid exposed portions of the interlayer insulating layers, and a part of the second external terminal that is formed on the second side surface is formed on the surfaces of the plurality of respective second electrode patterns exposed to the second side surface so as to avoid exposed portions of the interlayer insulating layers.

According to the present invention, in a coil component of a type that is mounted in a laid-down posture such that the lamination direction thereof is perpendicular to a printed circuit board, parts of the first and second external terminals that are formed respectively on the first and second side surfaces each do not have a so-called solid pattern but a shape avoiding the exposed portions of the interlayer insulating layers, so that when the coil component is mounted on a printed circuit board using a solder, spread of a fillet is restricted by the exposed portions of the interlayer insulating layers. This allows a reduction in the size of the fillet, which in turn can reduce a mounting area on the printed circuit board. In addition, even when a stress is applied to the first and second external terminals due to temperature change or the like, the stress is alleviated by the exposed portions of the interlayer insulating layers as compared to the case where the first and second external terminals each have a solid pattern, making it possible to prevent the occurrence of cracks due to the stress.

In the present invention, at least one of the plurality of first via conductors may be exposed to the first side surface, at least one of the plurality of second via conductors may be exposed to the second side surface, a part of the first external terminal that is formed on the first side surface may further be formed on the surface of the first via conductor exposed to the first side surface, and a part of the second external terminal that is formed on the second side surface may further be formed on the surface of the second via conductor exposed to the second side surface. With this configuration, the first and second external electrodes are formed also on the surfaces of the first and second via conductors, respectively, DC resistance can be reduced.

In the present invention, the plurality of conductor layers may include first, second, and third conductor layers which are laminated in this order in the lamination direction, the plurality of first via conductors may include a first connection part connecting the first electrode pattern included in the first conductor layer and the first electrode pattern included in the second conductor layer and a second connection part connecting the first electrode pattern included in the second conductor layer and the first electrode pattern included in the third conductor layer, the plurality of second via conductors may include a third connection part connecting the second electrode pattern included in the first conductor layer and the second electrode pattern included in the second conductor layer and a fourth connection part connecting the second electrode pattern included in the second conductor layer and the second electrode pattern included in the third conductor layer, a part of the first connection part that is exposed to the first side surface and a part of the second connection part that is exposed to the first side surface may not overlap each other as viewed in the lamination direction, and a part of the third connection part that is exposed to the second side surface and a part of the fourth connection part that is exposed to the second side surface may not overlap each other as viewed in the lamination direction. With this configuration, the first and second external terminals formed respectively on the first and second side surfaces each have a meander shape, making it possible to efficiently prevent the fillet from spreading in the lamination direction.

In the present invention, at least one of the first and second magnetic layers may be made of a composite magnetic material composed of resin containing magnetic powder. This allows an inner diameter part of the coil conductor pattern to be filled with a magnetic material simultaneously with, e.g., formation of first or second magnetic layer.

In the present invention, the element body may have a rectangular shape as viewed in the lamination direction, and first, second, third and fourth corners as viewed in the lamination direction may each be made of a composite magnetic material. This reduces the magnetic resistance of the element body, making it possible to obtain high inductance.

In the present invention, the element body may further have third and fourth side surfaces which are perpendicular to the first and second side surfaces and opposed to each other, and the plurality of interlayer insulating layers may be exposed to the third and fourth side surfaces. This allows a further reduction in planar size of the coil component.

As described above, according to the present invention, there can be provided an improved coil component suitable for height reduction and having a reduced mounting area on the printed circuit board.

BRIEF DESCRIPTION OF THE DRAWINGS

The above features and advantages of the present invention will be more apparent from the following description of certain preferred embodiments taken in conjunction with the accompanying drawings, in which:

FIG. 1A shows the coil component as viewed from one side thereof, and FIG. 1B shows the same as viewed from the opposite side thereof;

DETAILED DESCRIPTION OF THE EMBODIMENTS

Preferred embodiments of the present invention will be explained below in detail with reference to the accompanying drawings.

Figure 1A:
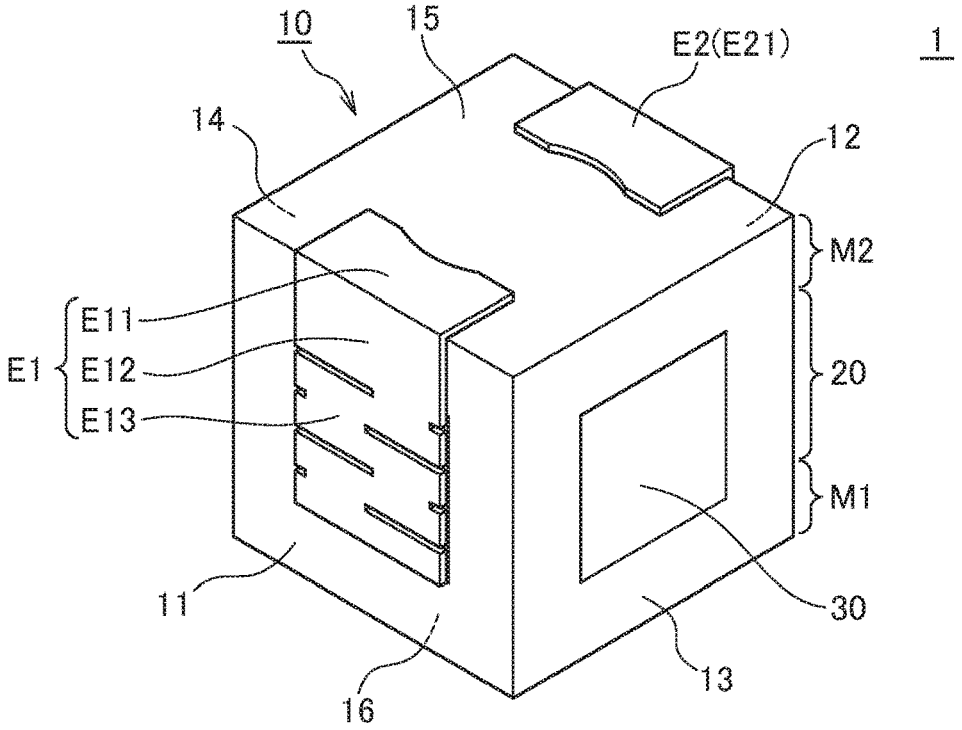
FIGS. 1A and 1B are schematic perspective views illustrating the outer appearance of a coil component according to a preferred embodiment of the present invention, where
Figure 1B:
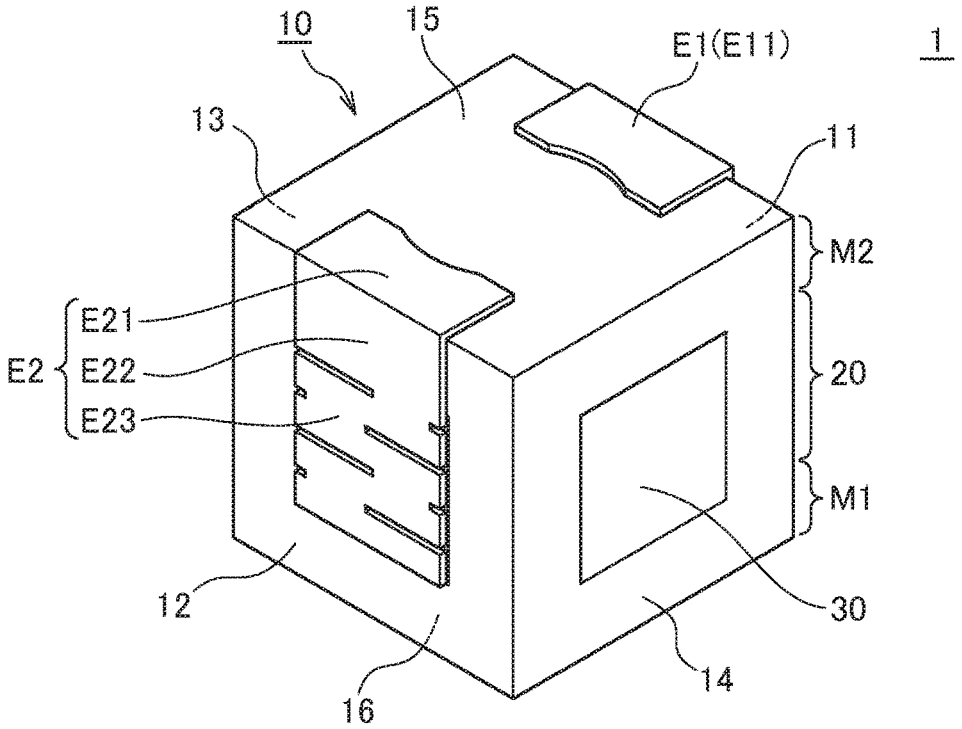

FIGS. 1A and 1B are schematic perspective views illustrating the outer appearance of a coil component 1 according to a preferred embodiment of the present invention, where FIG. 1A shows the coil component 1 as viewed from one side thereof, and FIG. 1B shows the same as viewed from the opposite side thereof.

As illustrated in FIGS. 1A and 1B, the coil component 1 according to the present embodiment has an element body 10 having a substantially parallelepiped shape and first and second external terminals E1 and E2 formed on the surface of the element body 10. The element body 10 has first and second magnetic layers M1 and M2 and a coil part 20 positioned between the first and second magnetic layers M1 and M2.

The element body 10 has first to fourth side surfaces 11 to 14, a mounting surface 15, and an upper surface 16. In actual use, the element body 10 is mounted such that the mounting surface 15 faces a printed circuit board. Thus, once mounted, the mounting surface 15 and upper surface 16 are parallel to the printed circuit board, and first to fourth side surfaces 11 to 14 are perpendicular to the printed circuit board. The first and second side surfaces 11 and 12 are opposed to each other, and third and fourth side surfaces 13 and 14 are opposed to each other. The first and second side surfaces 11 and 12 are perpendicular to the third and fourth side surfaces 13 and 14.

The first external terminal E1 is constituted of an electrode part E11 formed on the mounting surface 15 and electrode parts E12 and E13 formed on the first side surface 11. The electrode part E12 is formed on the surface of the second magnetic layer M2, and the electrode part E13 is formed on the surface of the coil part 20. Similarly, the second external terminal E2 is constituted of an electrode part E21 formed on the mounting surface 15 and electrode parts E22 and E23 formed on the second side surface 12. The electrode part E22 is formed on the surface of the second magnetic layer M2, and the electrode part E23 is formed on the surface of the coil part 20.

The first and second magnetic layers M1 and M2 are each made of a composite magnetic material composed of resin containing magnetic powder such as ferrite powder or metal magnetic powder and constitutes a magnetic path of magnetic flux generated by making a current flow in the coil component 1 according to the present embodiment. When the metal magnetic powder is used as the magnetic powder, iron powder is preferably used. As the resin, liquid or powder epoxy resin is preferably used. However, in the present invention, it is not essential to constitute both the first and second magnetic layers M1 and M2 by the composite magnetic material and, for example, a substrate made of a magnetic material such as sintered ferrite may be used as the first magnetic layer M1.

As described later, the coil part 20 has a structure in which a plurality of conductor layers and a plurality of interlayer insulating layers are alternately laminated in the lamination direction. In the coil component 1 according to the present embodiment, an interlayer insulating layer 30 is exposed to the first to fourth side surfaces 11 to 14. Accordingly, no magnetic material exists at a part to which the interlayer insulating layer 30 is exposed.

Figure 2:
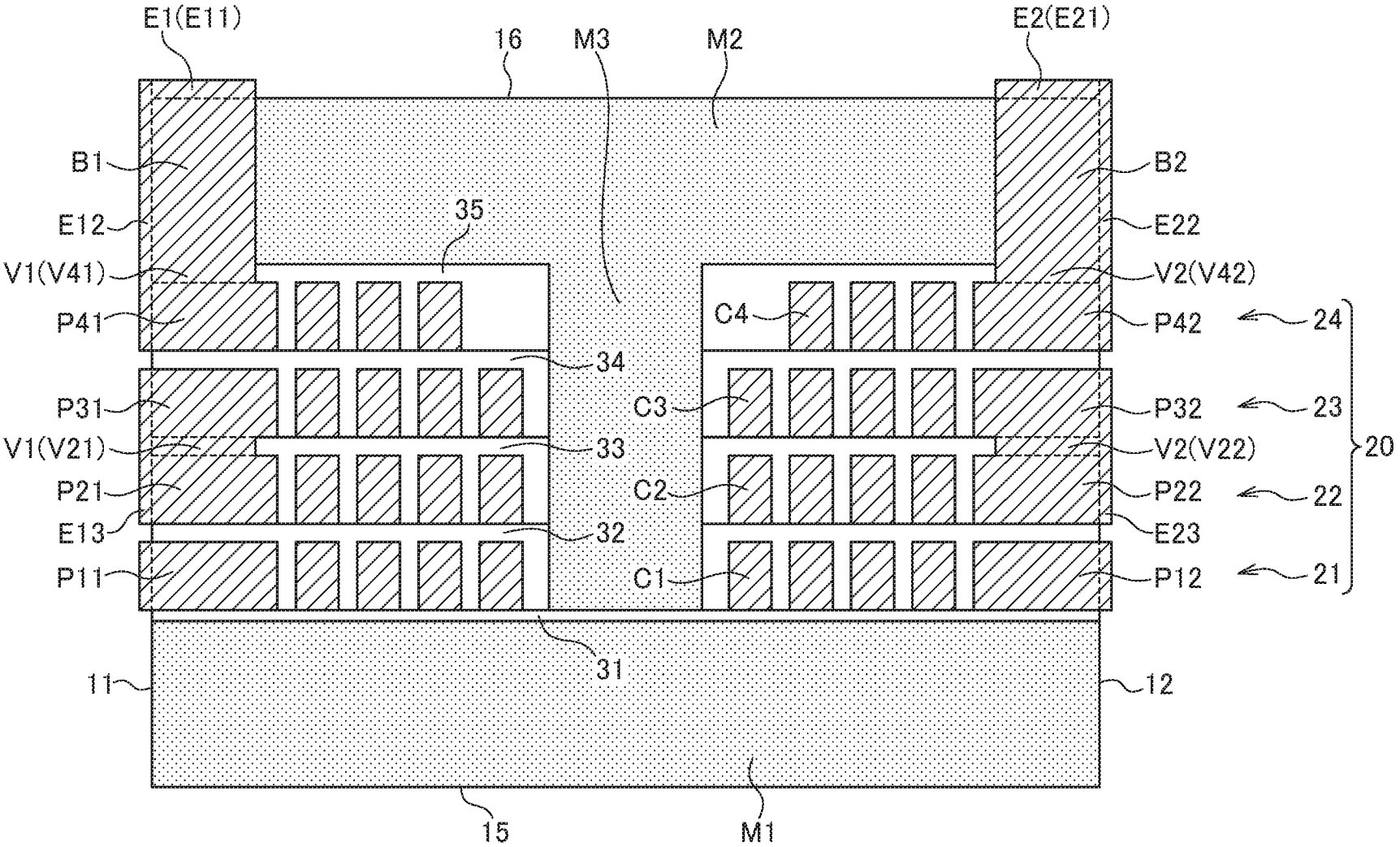
FIG. 2 is a schematic cross-sectional view along the lamination direction of the coil component according to a preferred embodiment of the present invention.

FIG. 2 is a schematic cross-sectional view along the lamination direction of the coil component 1 according to the present embodiment.

As illustrated in FIG. 2, the coil part 20 included in the coil component 1 has a structure in which conductor layers 21 to 24 and interlayer insulating layers 31 to 35 are alternately laminated in the lamination direction. Specifically, from the first magnetic layer M1 toward the second magnetic layer M2, the interlayer insulating layer 31, conductor layer 21, interlayer insulating layer 32, conductor layer 22, interlayer insulating layer 33, conductor layer 23, interlayer insulating layer 34, conductor layer 24, and interlayer insulating layer 35 are laminated in this order. The interlayer insulating layers 31 to 35 are each made of a non-magnetic resin material and collectively correspond to the interlayer insulating layer 30 illustrated in FIG. 1. The coil part 20 has a magnetic pillar M3 that connects the first and second magnetic layers M1 and M2. The first magnetic layer M1 and magnetic pillar M3 may contact each other, or the interlayer insulating layer 31 may be interposed between the first magnetic layer M1 and the magnetic pillar M3, as illustrated in FIG. 2.

The conductor layers 21 to 24 have spirally wound coil conductor patterns C1 to C4, respectively. As described later, the coil conductor patterns C1 to C4 are mutually connected to constitute a single coil. One end of the coil is connected to the first external terminal E1, and the other end thereof is connected to the second external terminal E2. In the present embodiment, the number of turns of each of the coil conductor patterns C1 to C3 is 4, and that of the coil conductor pattern C4 is 3.5. Thus, in total, the coil has 15.5 turns.

The conductor layers 21 to 24 each have first and second electrode patterns. Specifically, the conductor layer 21 has first and second electrode patterns P11 and P12, the conductor layer 22 has first and second electrode patterns P21 and P22, the conductor layer 23 has first and second electrode patterns P31 and P32, and the conductor layer 24 has first and second electrode patterns P41 and P42. The first electrode patterns P11, P21, P31, P41 are mutually connected through a first via conductor V1 (only connection parts V21 and V41 of the first via conductor V1 appear in the cross section of FIG. 2, and the formation positions of the remaining connection parts V11 and V31 of the first via conductor V1 will be described later). Similarly, the second electrode patterns P12, P22, P32, P42 are mutually connected through a second via conductor V2 (only connection parts V22 and V42 of the second via conductor V2 appear in the cross section of FIG. 2, and the formation positions of the remaining connection parts V12 and V32 of the second via conductor V2 will be described later).

The first electrode patterns P11, P21, P31, P41 and the first via conductor V1 are exposed to the first side surface 11 of the element body 10. Of these, the electrode pattern P41 positioned in the uppermost layer is connected to a first bump electrode B1 through the connection part V41 of the first via conductor V1. Similarly, the second electrode patterns P12, P22, P32, P42 and the second via conductor V2 are exposed to the second side surface 12 of the element body 10. Of these, the electrode pattern P42 positioned in the uppermost layer is connected to a second bump electrode B2 through the connection part V42 of the second via conductor V2. The first and second bump electrodes B1 and B2 each penetrate the second magnetic layer M2.

As illustrated in FIG. 2, the electrode part E11 of the first external terminal E1 is connected to the first bump electrode B1. The first bump electrode B1 is exposed to the first side surface 11 of the element body 10, and the electrode part E12 of the first external terminal E1 is formed on the exposed surface of the first bump electrode B1. Further, the electrode part E13 of the first external terminal E1 is formed on the exposed surfaces of the first electrode patterns P11, P21, P31, P41 and the first via conductor V1. Similarly, the electrode part E21 of the second external terminal E2 is connected to the second bump electrode B2. The second bump electrode B2 is exposed to the second side surface 12 of the element body 10, and the electrode part E22 of the second external terminal E2 is formed on the exposed surface of the second bump electrode B2. Further, the electrode part E23 of the second external terminal E2 is formed on the exposed surfaces of the second electrode patterns P12, P22, P32, P42 and the second via conductor V2.

In the cross section illustrated in FIG. 2, the interlayer insulating layers 32 and 34 are each exposed to the first and second side surfaces 11 and 12 of the element body 10. In the other not-shown cross sections, the interlayer insulating layers 33 and 35 are each also exposed to the first and second side surfaces 11 and 12. The electrode part E13 of the first external terminal E1 is formed on the exposed surfaces of the first electrode patterns P11, P21, P31, P41 and the first via conductor V1 so as to avoid the exposed portions of the interlayer insulating layers 32 to 35. Similarly, the electrode part E23 of the second external terminal E2 is formed on the exposed surfaces of the second electrode patterns P12, P22, P32, P42 and the second via conductor V2 so as to avoid the exposed portions of the interlayer insulating layers 32 to 35.

Figure 3:
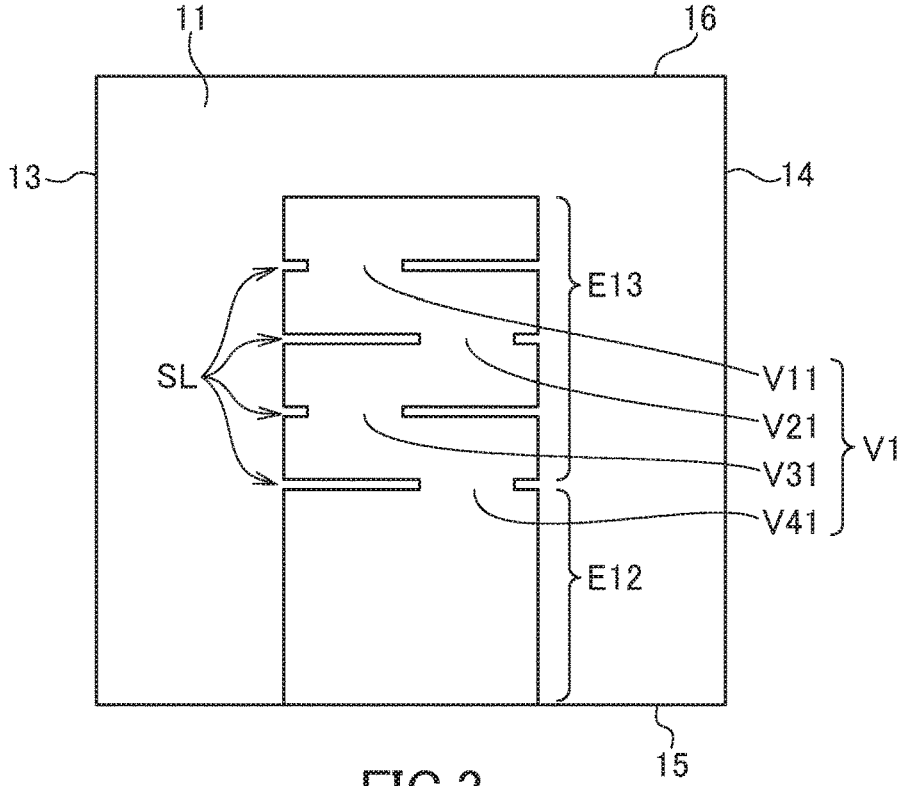
FIG. 3 is a side view illustrating the shape of the first external terminal formed on the first side surface of the element body.

FIG. 3 is a side view illustrating the shape of the first external terminal E1 formed on the first side surface 11 of the element body 10.

As illustrated in FIG. 3, the electrode part E12 of the first external terminal E1 has a so-called solid pattern, while the electrode part E13 of the first external electrode E1 does not have a solid pattern but has formed therein a plurality of slits SL. The slit SL is a portion where the first external terminal E1 is absent due to exposure of the interlayer insulating layers 32 to 35. On the other hand, the first external terminal E1 is formed at a portion where the first via conductor V1 is exposed. In the example of FIG. 3, two adjacent exposed portions of the first via conductor V1 in the lamination direction do not overlap each other as viewed in the lamination direction. That is, the connection part V11 and the connection part V21 do not overlap each other in the lamination direction, connection part V21 and the connection part V31 do not overlap each other in the lamination direction, and connection part V31 and the connection part V41 do not overlap each other in the lamination direction. On the other hand, the horizontal direction positions of the connection part V11 and V31 coincide with each other, and the horizontal direction positions of the connection part V21 and V41 coincide with each other. As a result, the electrode part E13 of the first external electrode E1 has a so-called meander shape. That is, the electrode part E13 is not completely segmented by the slits SL, and thus, DC resistance hardly increases.

Figure 4:
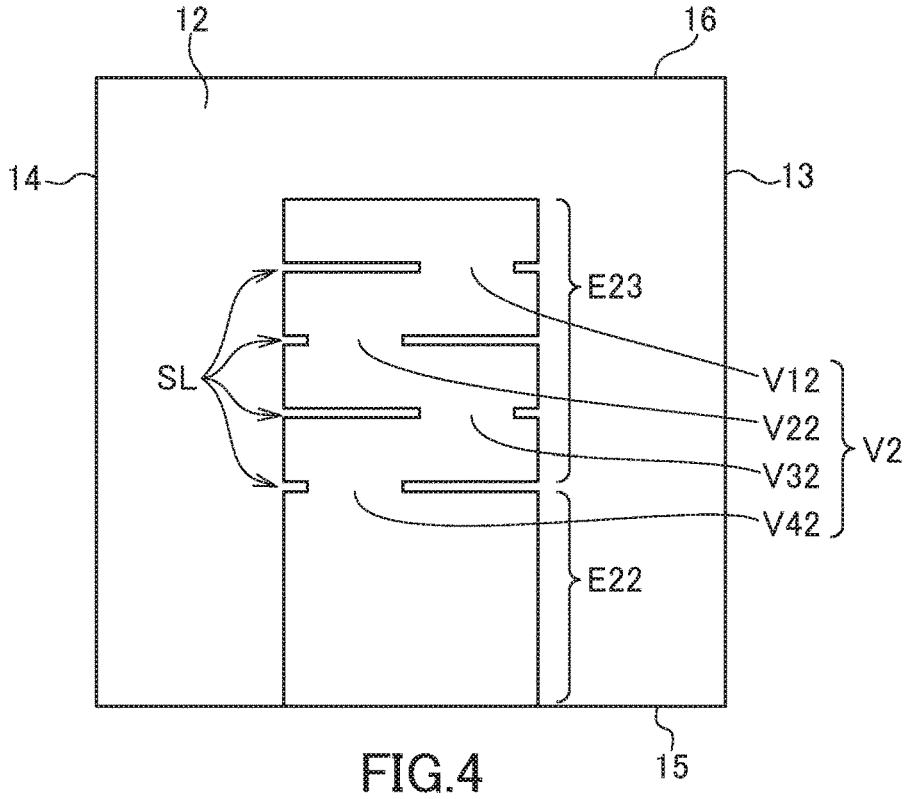
FIG. 4 is a side view illustrating the shape of the second external terminal formed on the second side surface of the element body.

The shape of the electrode part E23 of the second external terminal E2 may be the same as the shape illustrated in FIG. 3. Alternatively, as the example illustrated in FIG. 4, the shape of the electrode part E23 of the second external terminal E2 may be a shape obtained by reversing the shape of the electrode part E13 of the first external terminal E1. The mutually reversed configuration facilitates the formation of the first and second via conductors V1 and V2 in the manufacturing process, which will be described later.

Figure 5:
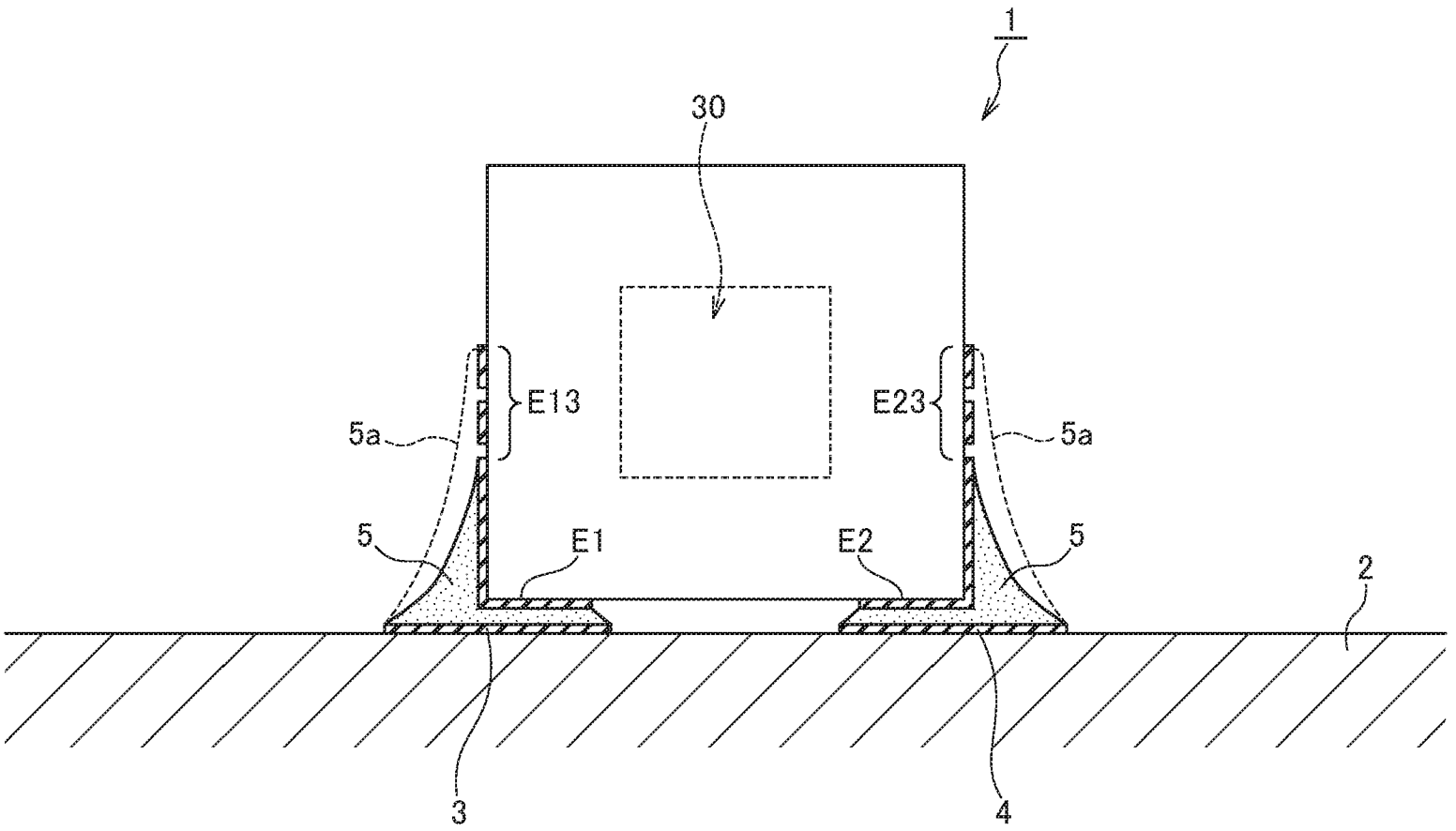
FIG. 5 is a schematic side view illustrating a state where the coil component according to a preferred embodiment of the present invention is mounted on a printed circuit board.

FIG. 5 is a schematic side view illustrating a state where the coil component 1 according to the present embodiment is mounted on a printed circuit board 2.

Two land patterns 3 and 4 are provided on the printed circuit board 2 illustrated in FIG. 5, and the coil component 1 according to the present embodiment is mounted on the land patterns 3 and 4. The first and second external terminals E1 and E2 provided on the coil component 1 are connected respectively to the land patterns 3 and 4 through a solder 5. The solder 5 forms a fillet covering the first and second side surfaces 11 and 12 of the element body 10. In the coil component 1 according to the present embodiment, the slits SL are each formed in the electrode parts E13 and E23 of the first and second external terminals E1 and E2, and thus the electrode parts E13 and E23 each have a meander planar shape, so that the fillet is prevented from spreading to the electrode parts E13 and E23. That is, the fillet of the solder 5 stops at the electrode parts E12 and E22, with the result that the fillet is not formed at all in the electrode parts E13 and E23, or the amount of the fillet, if any, formed therein is small.

Thus, the fillet size is reduced, so that a short-circuit fault with other neighboring electronic components becomes unlikely to occur, allowing a reduction in the mounting area on the printed circuit board. In FIG. 5, spread of the fillet when the electrode parts E13 and 23 of the first and second external terminals E1 and E2 each have a solid pattern is denoted by a dashed line 5*a*. As denoted by the dashed line 5*a*, when the electrode parts E13 and E23 each have a solid pattern, the size of the fillet is increased not only in the height direction but also in the planar direction, so that in order to prevent a short-circuit fault with other neighboring electronic components, it is necessary to increase a mounting interval between electrode components. On the other hand, in the coil component 1 according to the present embodiment, the fillet of the solder 5 is prevented from spreading, so that higher density mounting becomes possible.

In addition, the area covered with the solder 5 is small, so that even when a stress is applied to the first and second external terminals E1 and E2 due to temperature change or the like, cracks become unlikely to occur in the first and second external terminals E1 and E2. That is, the electrode parts E13 and 23 each have a meander shape, and highly flexible interlayer insulating layers 32 to 35 are exposed at the respective slits SL, so that even when a stress is applied to the first and second external terminals E1 and E2 due to temperature change or the like, the electrode parts E13 and E23 can be deformed larger than the case where they each have a solid pattern. Thus, the stress is released, so that cracks become unlikely to occur in the first and second external terminals E1 and E2.

The following describes a manufacturing method for the coil component 1 according to the present embodiment.

FIGS. 6 to 17 are process views for explaining the manufacturing method for the coil component 1 according to the present embodiment. In the present embodiment, a large number of coil components 1 are produced at a time on an aggregate substrate, followed by individualization. FIGS. 6 to 14 and FIG. 16 are schematic plan views each illustrating only a part corresponding to four coil components 1. Dashed lines Dx and Dy are dicing lines, and individual areas surrounded by the dashed lines Dx and Dy each correspond to one coil component 1.

Figure 6:
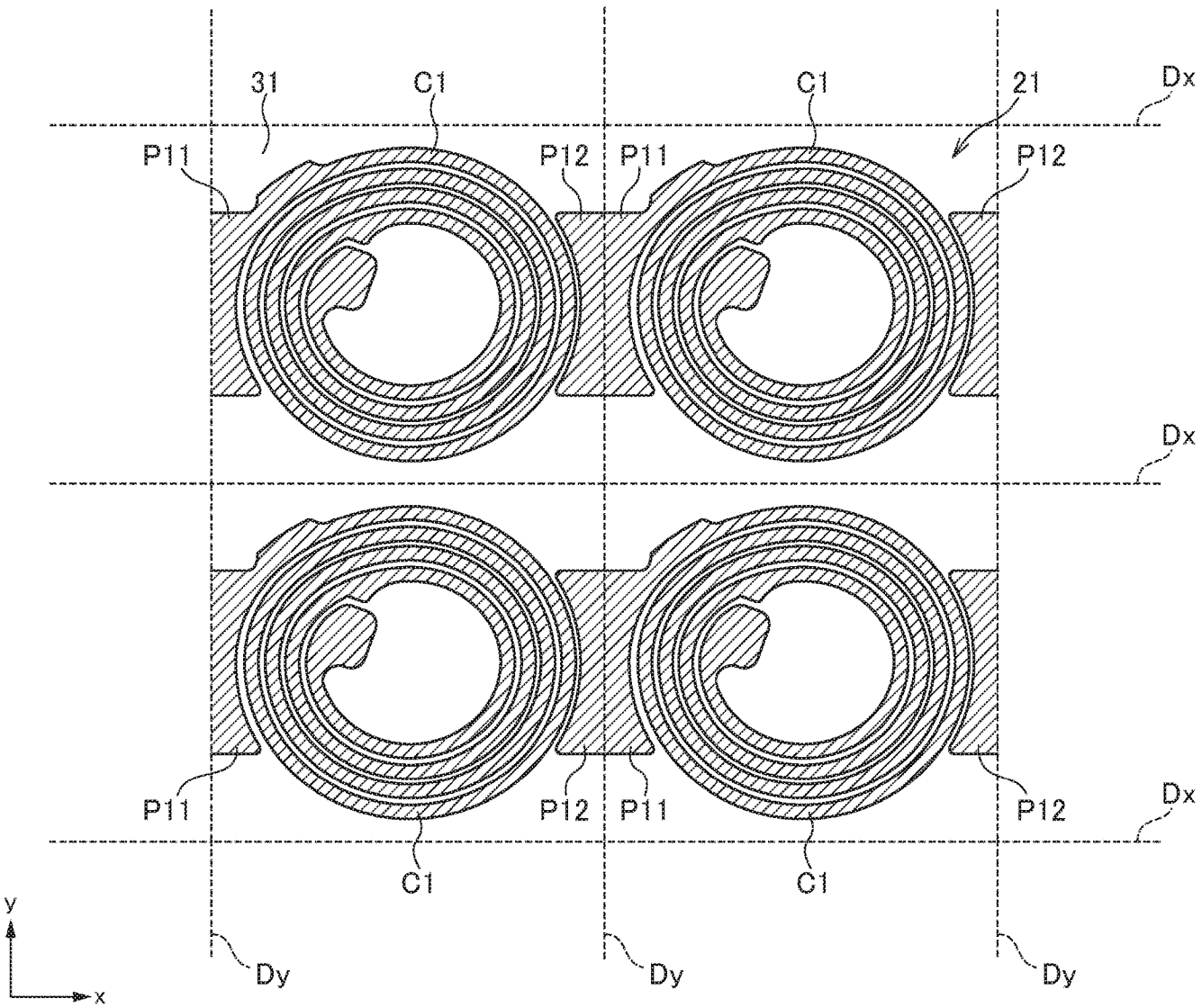
FIGS. 6 to 17 are process views for explaining the manufacturing method for the coil component according to a preferred embodiment of the present invention.

First, the interlayer insulating layer 31 is formed on the surface of the first magnetic layer M1 and then, as illustrated in FIG. 6, the first conductor layer 21 is formed on the surface of the interlayer insulating layer 31. The interlayer insulating layer 31 is preferably formed by applying a resin material using a spin coating method. The same applies to the interlayer insulating layers 32 to 35 to be formed subsequently. When the first magnetic layer M1 is a substrate made of ferrite or the like, it may be used as an aggregate substrate, while when a composite magnetic material is used as the first magnetic layer M1, another support member is used, and the support member is finally ground to be removed, followed by formation of the first magnetic layer M1 made of the composite magnetic material.

The first conductor layer 21 is preferably formed as follows: an underlying metal film is formed using a thin film process such as a sputtering method, patterned using a photolithography method, and plated/grown to a desired film thickness using an electrolytic plating method. The same applies to the conductor layers 22 to 24 to be formed subsequently. The first conductor layer 21 includes the first coil conductor pattern C1 and first and second electrode patterns P11 and P12. The first coil conductor pattern C1 is wound rightward (clockwise) from the outer peripheral end toward the inner peripheral end, and the outer peripheral end thereof is connected to the first electrode pattern P11. The second electrode pattern P12 is not connected to its corresponding first coil conductor pattern C1 in a plane. The first and second electrode patterns P11 and P12 of the respective coil components 1 adjacent in the x-direction are integrated with each other.

Figure 7:
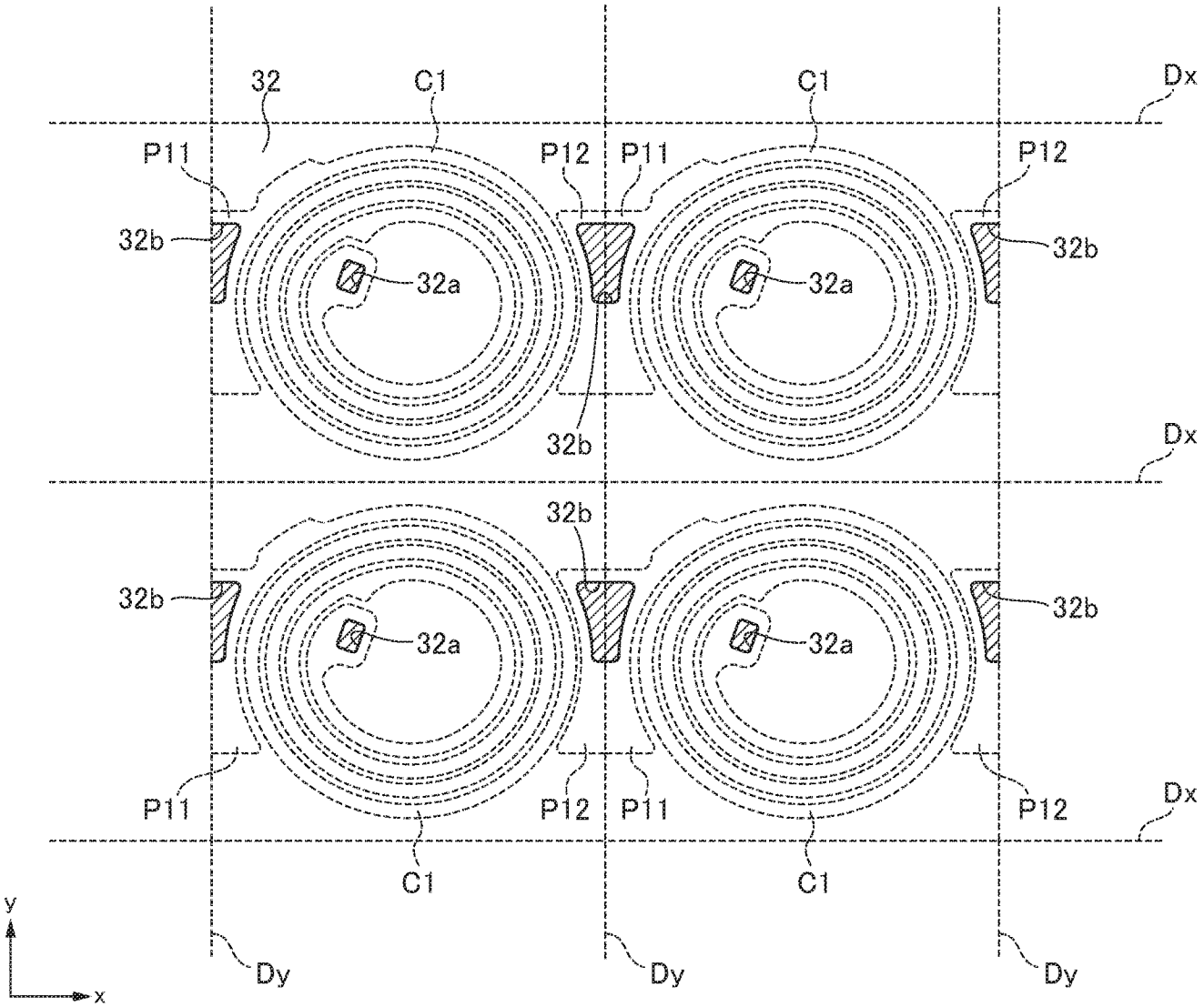

Then, as illustrated in FIG. 7, the entire resultant surface is covered with the interlayer insulating layer 32, and openings 32*a* and 32*b* are formed in the interlayer insulating layer 32. The openings 32*a* and 32*b* are preferably formed by patterning using a photolithography method. The same is applied to openings to be formed subsequently. The opening 32*a* is formed at a position through which the inner peripheral end of the first coil conductor pattern C1 is exposed, and the opening 32*b* is formed at a position through which the first and second electrode patterns P11 and P12 are to be exposed. In particular, the opening 32*b* is commonly provided for the first and second electrode patterns P11 and P12 of the respective coil components 1 adjacent in the x-direction. It follows that the opening 32*b* is positioned on the dicing line Dy. The opening 32*b* is provided at a position offset to one side (upper side in FIG. 7) in the y-direction from the center of the first coil conductor pattern C1.

Figure 8:
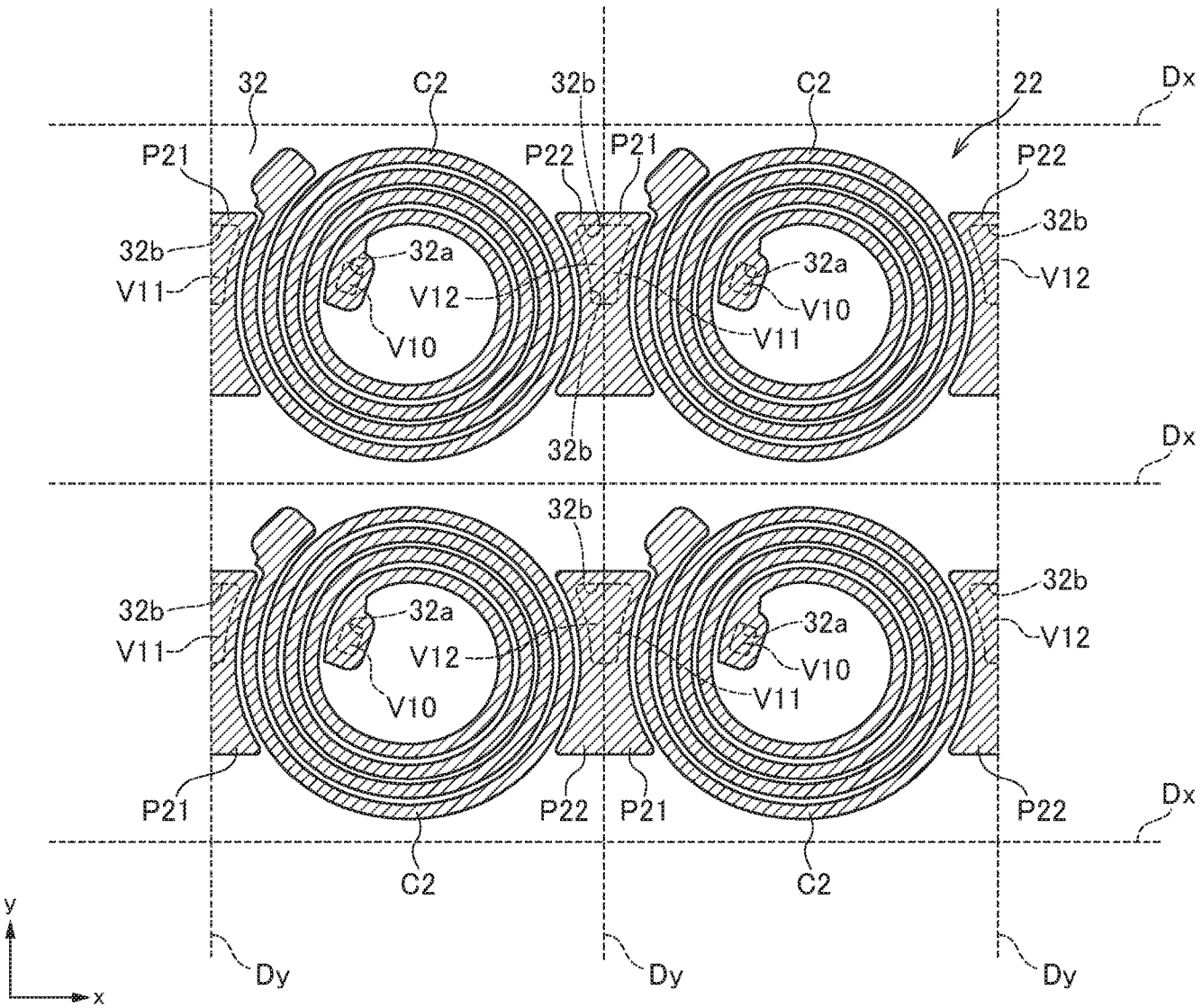

Then, as illustrated in FIG. 8, the second conductor layer 22 is formed on the surface of the interlayer insulating layer 32. The second conductor layer 22 includes the second coil conductor pattern C2 and the first and second electrode patterns P21 and P22. The second coil conductor pattern C2 is wound rightward (clockwise) from the inner peripheral end toward the outer peripheral end. The first and second electrode patterns P21 and P22 are not connected to their corresponding second coil conductor pattern C2 in a plane. The first and second electrode patterns P21 and P22 of the respective coil components 1 adjacent in the x-direction are integrated with each other.

As a result, the inner peripheral end of the first coil conductor pattern C1 and the inner peripheral end of the second coil conductor pattern C2 are connected to each other through a connection part V10 provided in the opening 32*a*. Further, the first and second electrode patterns P11 and P12 are connected respectively to the first and second electrode patterns P21 and P22 through the respective connection parts V11 and V12 provided in the opening 32*b*. At this point of time, the connection parts V11 and V12 are integrated and positioned on the dicing line Dy.

Figure 9:
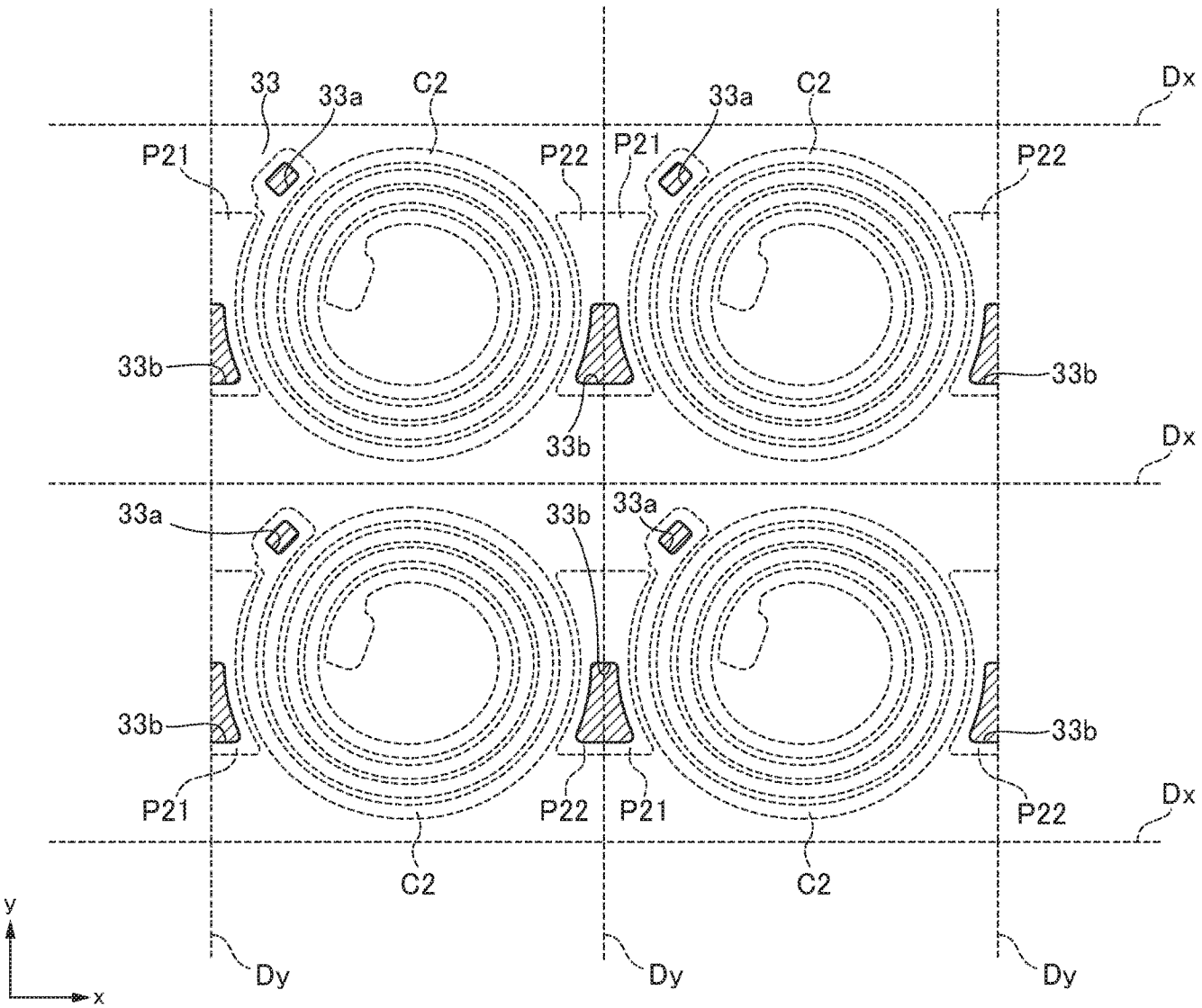

Then, as illustrated in FIG. 9, the entire resultant surface is covered with the interlayer insulating layer 33, and openings 33*a* and 33*b* are formed in the interlayer insulating layer 33. The opening 33*a* is formed at a position through which the outer peripheral end of the second coil conductor pattern C2 is to be exposed, and the opening 33*b* is formed at a position through which the first and second electrode patterns P21 and P22 are to be exposed. In particular, the opening 33*b* is commonly provided for the first and second electrode patterns P21 and P22 of the respective coil components 1 adjacent in the x-direction. It follows that the opening 33*b* is positioned on the dicing line Dy. The opening 33*b* is provided at a position offset to the other side (lower side in FIG. 9) in the y-direction from the center of the second coil conductor pattern C2.

Figure 10:
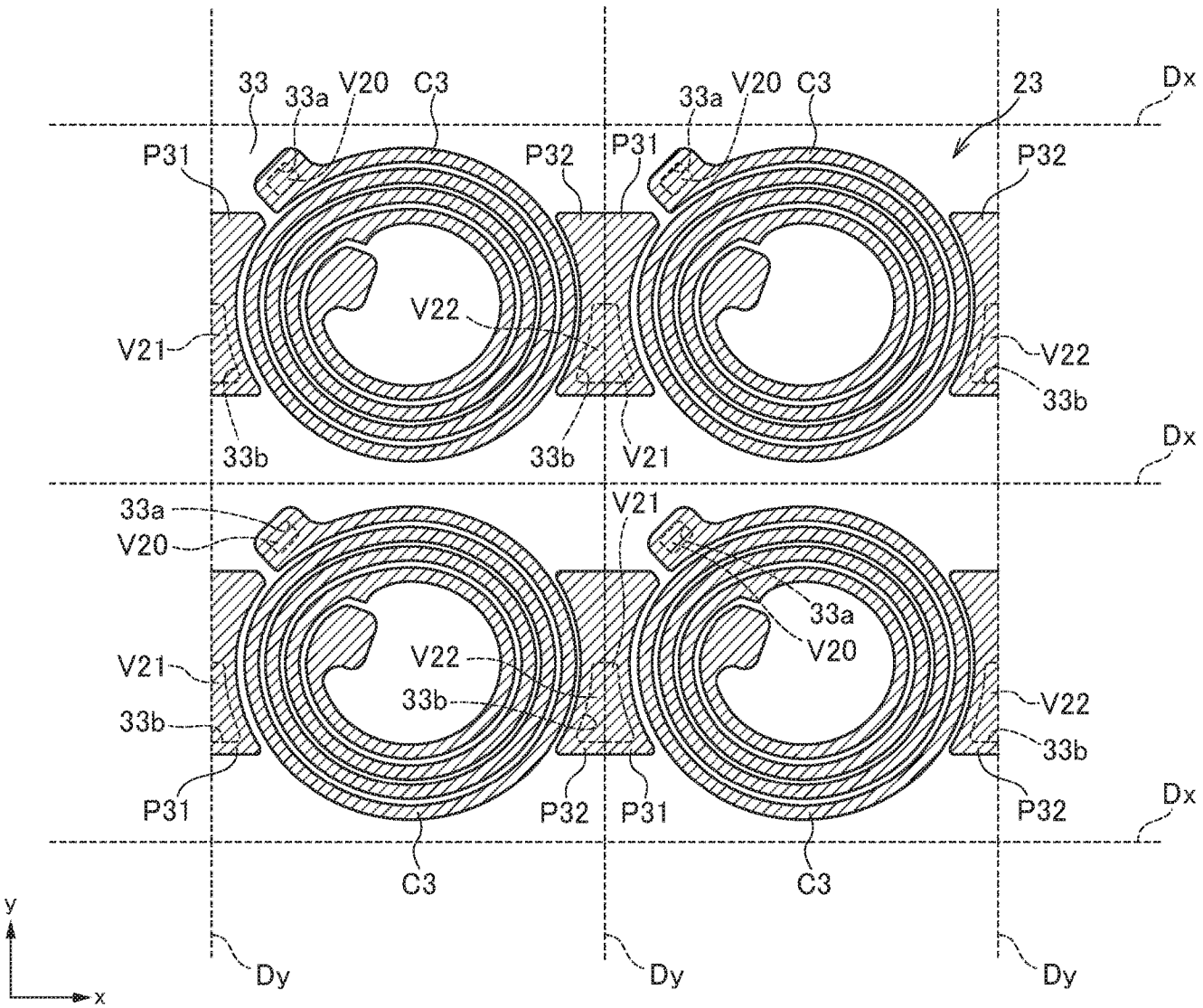

Then, as illustrated in FIG. 10, the third conductor layer 23 is formed on the surface of the interlayer insulating layer 33. The third conductor layer 23 includes the third coil conductor pattern C3 and first and second electrode patterns P31 and P32. The third coil conductor pattern C3 is wound rightward (clockwise) from the outer peripheral end toward the inner peripheral end. The first and second electrode patterns P31 and P32 are not connected to their corresponding third coil conductor pattern C3 in a plane. The first and second electrode patterns P31 and P32 of the respective coil components 1 adjacent in the x-direction are integrated with each other.

As a result, the outer peripheral end of the second coil conductor pattern C2 and the outer peripheral end of the third coil conductor pattern C3 are connected to each other through a connection part V20 provided in the opening 33*a*. Further, the first and second electrode patterns P21 and P22 are connected respectively to the first and second electrode patterns P31 and P32 through the respective connection parts V21 and V22 provided in the opening 33*b*. At this point of time, the connection parts V21 and V22 are integrated and positioned on the dicing line Dy.

Figure 11:
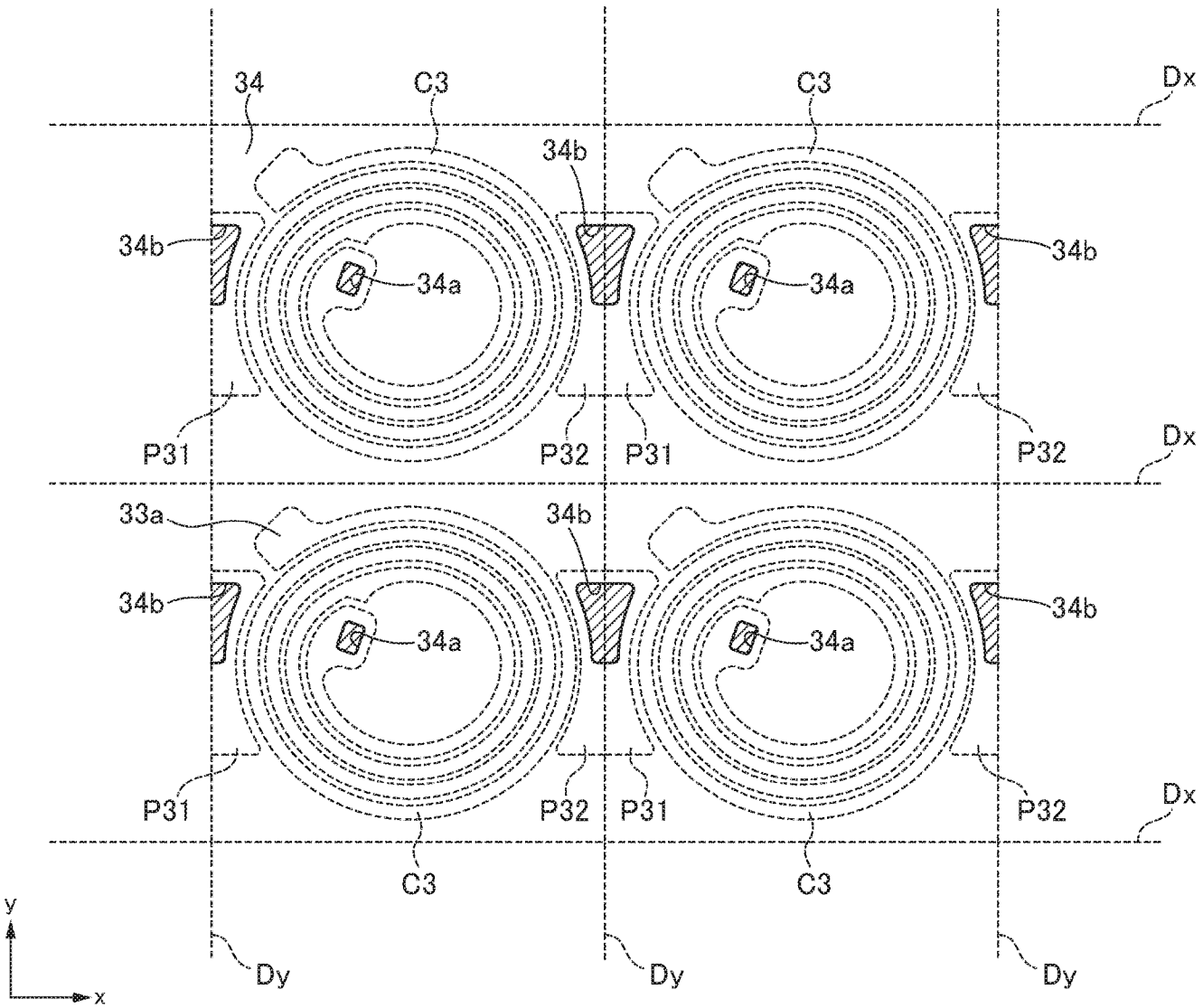

Then, as illustrated in FIG. 11, the entire resultant surface is covered with the interlayer insulating layer 34, and openings 34*a* and 34*b* are formed in the interlayer insulating layer 34. The opening 34*a* is formed at a position through which the inner peripheral end of the third coil conductor pattern C3 is to be exposed, and the opening 34*b* is formed at a position through which the first and second electrode patterns P31 and P32 are to be exposed. In particular, the opening 34*b* is commonly provided for the first and second electrode patterns P31 and P32 of the respective coil components 1 adjacent in the x-direction. It follows that the opening 34*b* is positioned on the dicing line Dy. The opening 34*b* is provided at a position offset to the one side (upper side in FIG. 11) in the y-direction from the center of the third coil conductor pattern C3.

Figure 12:
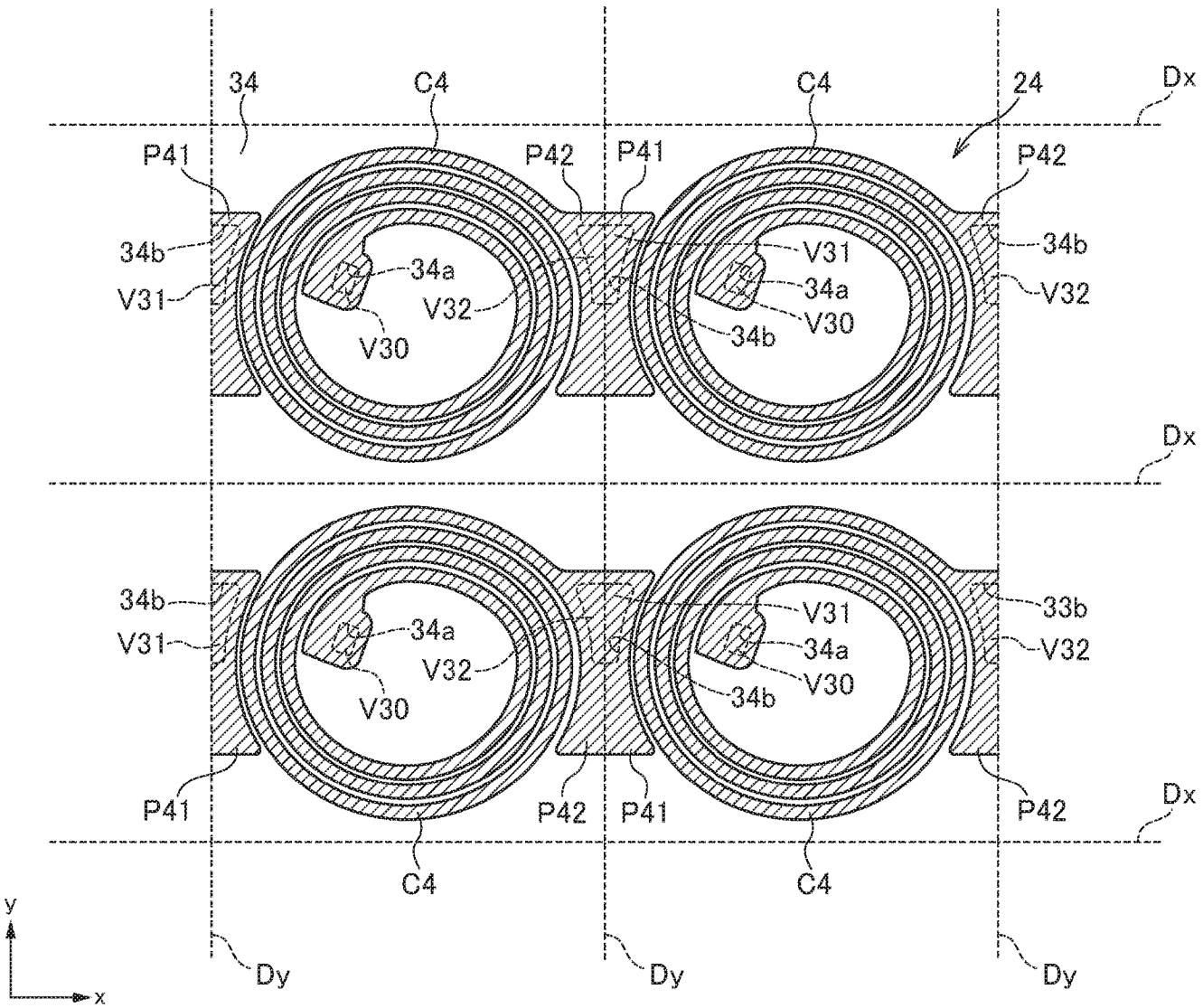

Then, as illustrated in FIG. 12, the fourth conductor layer 24 is formed on the surface of the interlayer insulating layer 34. The fourth conductor layer 24 includes the fourth coil conductor pattern C4 and first and second electrode patterns P41 and P42. The fourth coil conductor pattern C4 is wound rightward (clockwise) from the inner peripheral end toward the outer peripheral end, and the outer peripheral end thereof is connected to the second electrode pattern P42. The first electrode pattern P41 is not connected to its corresponding fourth coil conductor pattern C4 in a plane. The first and second electrode patterns P41 and P42 of the respective coil components 1 adjacent in the x-direction are integrated with each other.

As a result, the inner peripheral end of the third coil conductor pattern C3 and the inner peripheral end of the fourth coil conductor pattern C4 are connected to each other through a connection part V30 provided in the opening 34*a*. Further, the first and second electrode patterns P31 and P32 are connected respectively to the first and second electrode patterns P41 and P42 through the respective connection parts V31 and V32 provided in the opening 34*b*. At this point of time, the connection parts V31 and V32 are integrated and positioned on the dicing line Dy.

Figure 13:
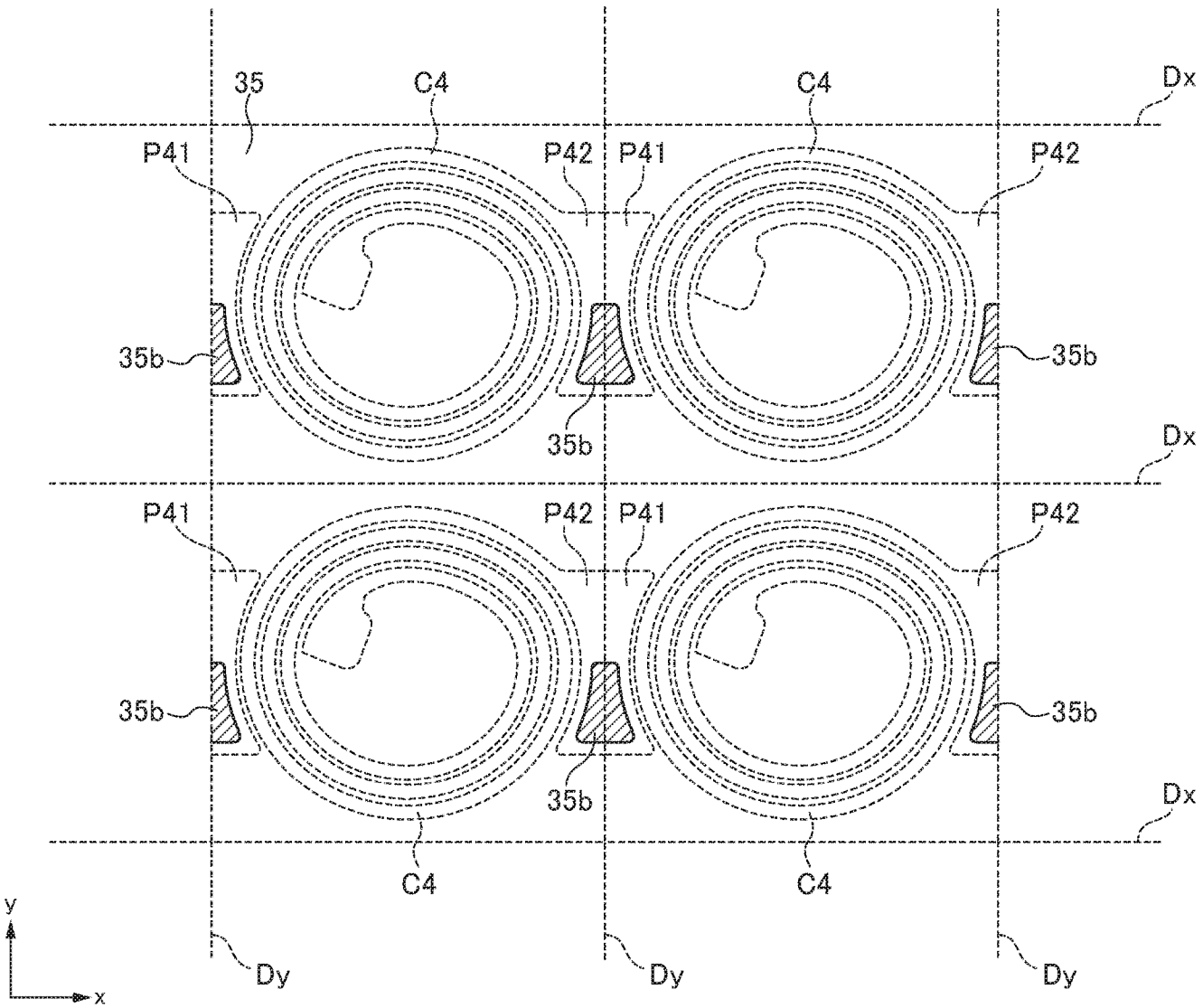

Then, as illustrated in FIG. 13, the entire resultant surface is covered with the interlayer insulating layer 35, and an opening 35*b* is formed in the interlayer insulating layer 35. The opening 35*b* is formed at a position through which the first and second electrode patterns P41 and P42 are to be exposed. The opening 35*b* is commonly provided for the first and second electrode patterns P41 and P42 of the respective coil components 1 adjacent in the x-direction. It follows that the opening 35*b* is positioned on the dicing line Dy. The opening 35*b* is provided at a position offset to the other side (lower side in FIG. 13) in the y-direction from the center of the fourth coil conductor pattern C4.

Figure 14:
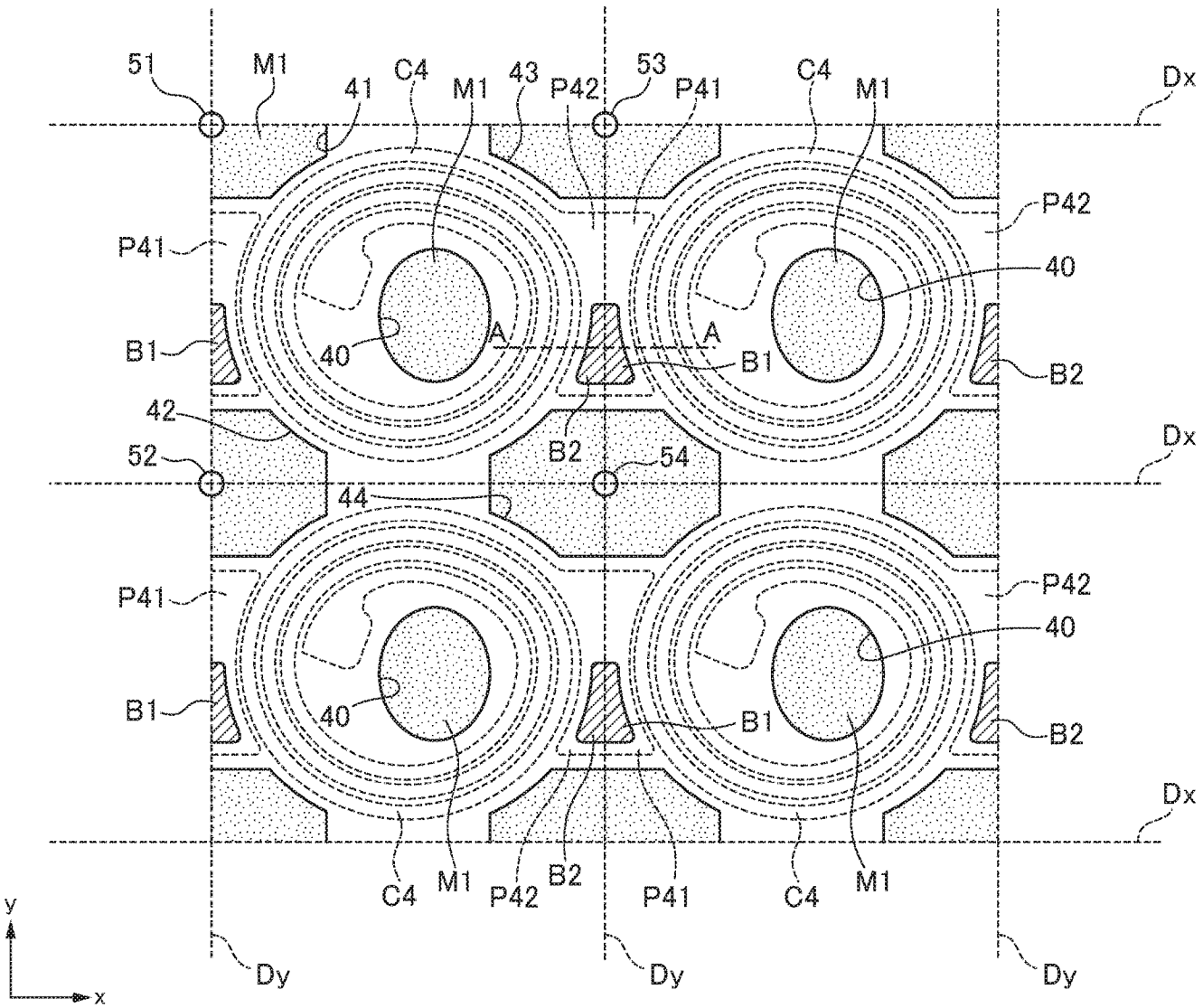

Then, as illustrated in FIG. 14, openings 40 to 44 reaching the first magnetic layer M1 are formed in the inner diameter part and peripheral part of each of the coil conductor patterns C1 to C4. The opening 40 is positioned at the inner diameter part of each of the coil conductor patterns C1 to C4, and the openings 41 to 44 are positioned at respective four corners 51 to 54 of the coil component 1. The corners 51 to 54 are each positioned at the boundary of the coil component 1, so that the openings 41 to 44 are collectively shared by four coil components 1. Thereafter, the first and second electrode patterns P41 and P42 exposed through the opening 35*b* are plated/grown to form the bump electrodes B1 and B2. Parts of the bump electrodes B1 and B2 that are formed inside the opening 35*b* constitute the connection parts V41 and V42, respectively.

The openings 40 to 44 may be formed by patterning the interlayer insulating layers 31 to 35 or may be formed by providing sacrificial patterns of the respective conductor layers 21 to 24 in planar positions where the openings 40 to 44 are to be formed and then removing the sacrificial patterns using acid or the like. According to these method, the interlayer insulating layer 31 positioned in the lowermost layer remains, whereby the cross-sectional structure illustrated in FIG. 2 can be obtained.

Figure 15:
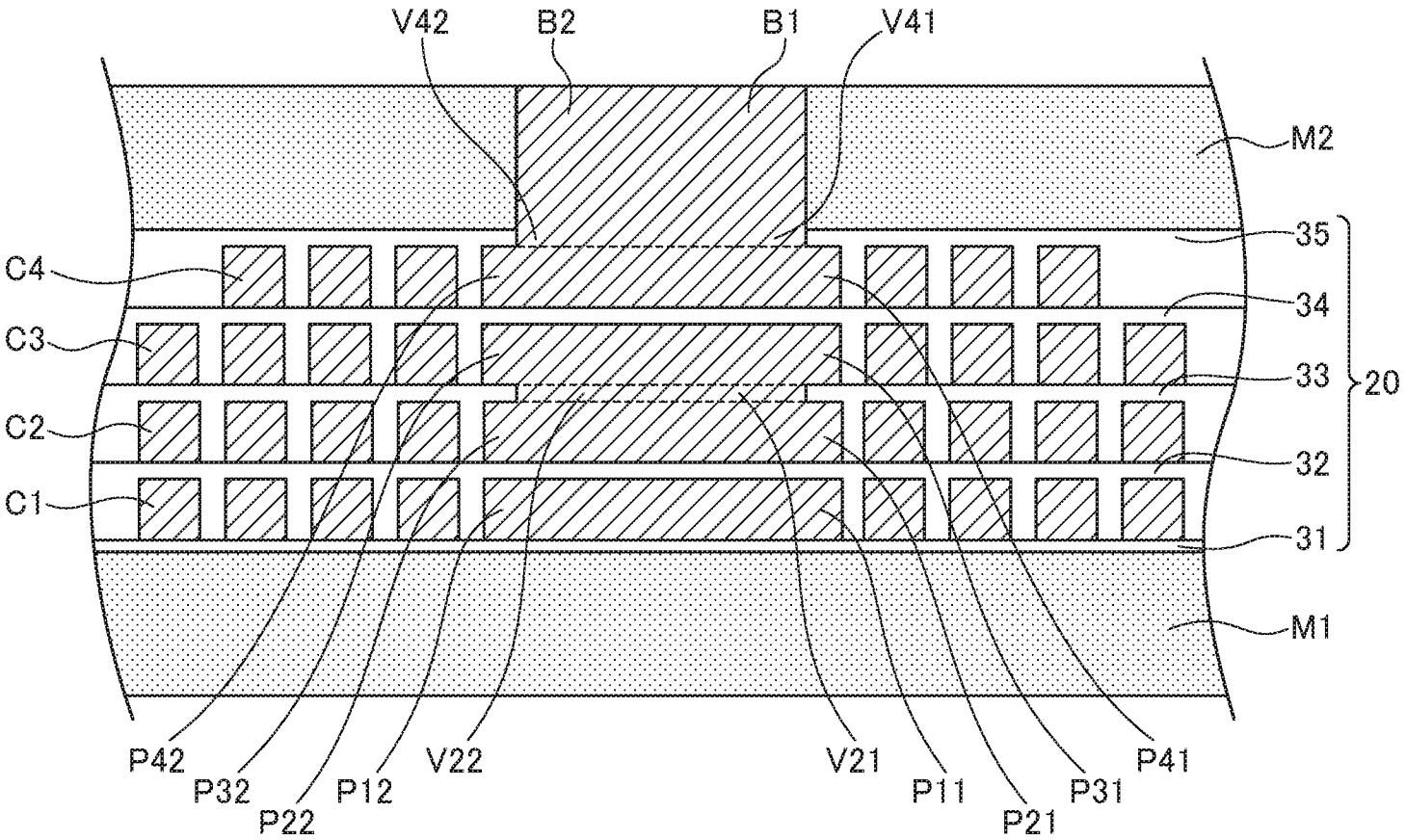

In this state, the entire resultant surface is covered with a composite magnetic material and, after that, the composite magnetic material is ground to be removed until the surfaces of the bump electrodes B1 and B2 are exposed. As a result, as illustrated in FIG. 15 that is a cross-sectional view corresponding to line A-A in FIG. 14, the second magnetic layer M2 is formed on the upper surface of the coil part 20. The bump electrodes B1 and B2 are connected respectively to the first and second electrode patterns P41 and P42 through the respective connection parts V41 and V42.

Figure 16:
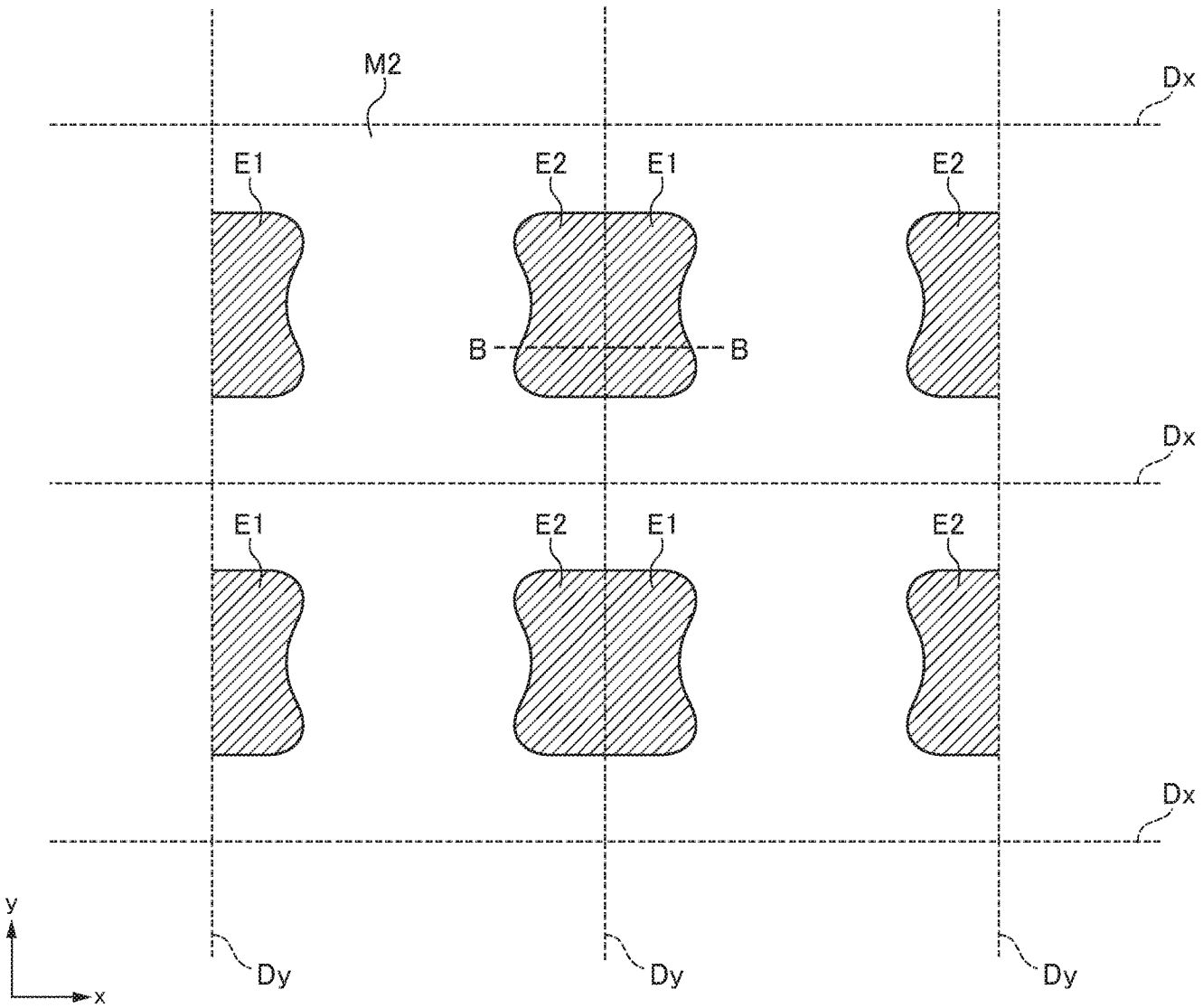
Figure 17:
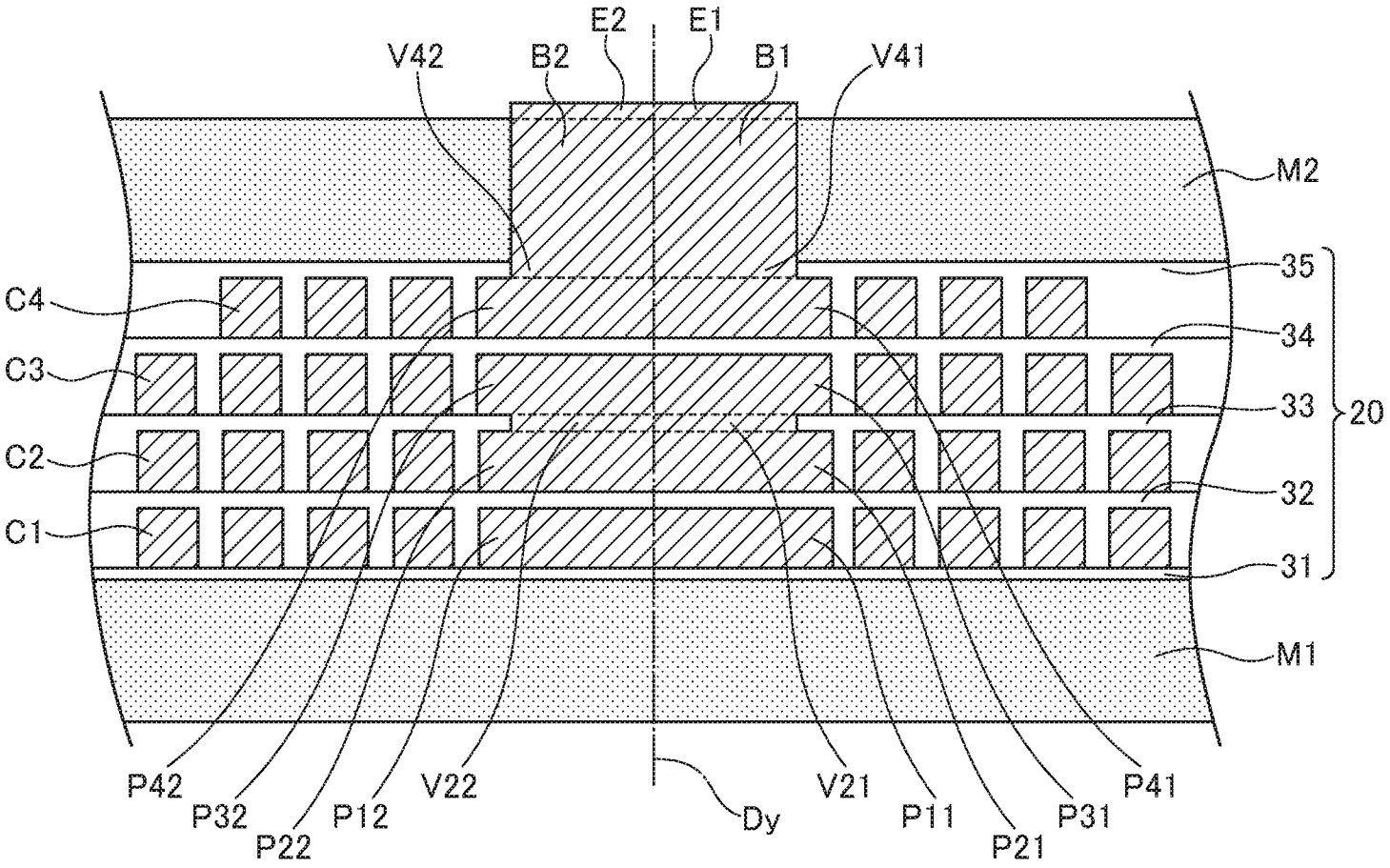

Then, as illustrated in FIG. 16, the first and second external terminals E1 and E2 are formed on the surface of the second magnetic layer M2 so as to contact the bump electrode B1 and B2. As a result, as illustrated in FIG. 17 that is a cross-sectional view corresponding to line B-B in FIG. 16, the first external terminal E1 is connected to the first electrode pattern P41 through the first bump electrode B1, and the second external terminal E2 is connected to the second electrode pattern P42 through the second bump electrode B2.

Then, cutting is performed along the dicing lines Dx and Dy for individualization, and plating is formed on the conductor layers 21 to 24 exposed to the cut surfaces, whereby the coil component 1 according to the present embodiment is completed. The electrode part E13 of the first external terminal E1 is formed on a part of each of the conductor layers 21 to 24 that is exposed to the cut surface (first side surface 11). More specifically, the electrode part E13 is formed on the surfaces of the first electrode patterns P11, P21, P31, P41 and the surfaces of the connection parts V11, V21, V31, V41 constituting the first via conductor V1. Similarly, the electrode part E23 of the second external terminal E2 is formed on a part of each of the conductor layers 21 to 24 that is exposed to the cut surface (second side surface 12). More specifically, the electrode part E23 is formed on the surfaces of the second electrode patterns P12, P22, P32, P42 and the surfaces of the connection parts V12, V22, V32, V42 constituting the second via conductor V2.

The electrode parts E13 and E23 of the first and second external terminals E1 and E2 are formed so as to avoid the exposed surfaces of the interlayer insulating layers 32 to 35, and the positions of the openings 32*b* to 35*b* alternate in the y-direction, allowing the electrode parts E13 and E23 to have a meander shape.

Further, the magnetic pillar M3 made of the same material as the second magnetic layer M2 is provided in the inner diameter part of each of the coil conductor patterns C1 to C4 and in a part of the peripheral area of each of the coil conductor patterns C1 to C4 that corresponds to the four corners 51 to 54, and a closed magnetic path is constituted by the magnetic layers M1, M2 and magnetic pillar M3. As a result, high inductance can be obtained.

As described above, the magnetic pillar M3 is positioned in a part of the peripheral area of each of the coil conductor patterns C1 to C4 that corresponds to the four corners 51 to 54 of the coil component 1 and does not exist at substantially the center of each of the first to fourth side surfaces 11 to 14. Thus, as compared to a structure in which the entire periphery of each of the coil conductor patterns C1 to C4 is surrounded by the magnetic pillar M3, the planar size of the coil component 1 can be reduced.

It is apparent that the present invention is not limited to the above embodiments, but may be modified and changed without departing from the scope and spirit of the invention.

For example, in the above embodiment, the first and second via conductors V1 and V2 are exposed to the first and second side surfaces 11 and 12, respectively; however, this is not essential in the present invention. Thus, the first and second via conductors V1 and V2 may exist only inside the element body 10 without being exposed to the first and second side surfaces 11 and 12. In this case, the electrode part E13 of the first external terminal E1 is segmented on the first side surface 11, and the electrode part E23 of the second external terminal E2 is segmented on the second side surface 12, so that the fillet of the solder 5 can be further reduced in size.

What is claimed is:

1. A coil component comprising:

an element body having first and second magnetic layers and a coil part positioned between the first and second magnetic layers, at least one of the first and second magnetic layers being made of a composite magnetic material composed of resin containing magnetic powder, the coil part having a plurality of conductor layers and a plurality of interlayer insulating layers which are alternately laminated in a lamination direction of the coil component; and first and second external terminals formed on the element body, wherein the element body comprises a mounting surface perpendicular to the lamination direction and a rectangular shape as viewed in the lamination direction, the element body further comprising first and second side surfaces that are parallel to the lamination direction and are opposed to each other and first, second, third and fourth corners as viewed in the lamination direction, each of the first, second, third and fourth corners being made of the composite magnetic material, the element body further comprising third and fourth side surfaces that are perpendicular to the first and second side surfaces and opposed to each other, the plurality of interlayer insulating layers being exposed to the third and fourth side surfaces, wherein the first external terminal is formed on the mounting surface and the first side surface, wherein the second external terminal is formed on the mounting surface and the second side surface, wherein each of the plurality of conductor layers has a coil conductor pattern, a first electrode pattern exposed to the first side surface, and a second electrode pattern exposed to the second side surface, wherein the first electrode patterns included in the plurality of respective conductor layers are connected to each other through a plurality of first via conductors which are formed so as to penetrate the plurality of interlayer insulating layers, wherein the second electrode patterns included in the plurality of respective conductor layers are connected to each other through a plurality of second via conductors which are formed so as to penetrate the plurality of interlayer insulating layers, wherein at least one of the plurality of interlayer insulating layers is exposed to the first side surface at a part thereof positioned between adjacent two of the first electrode patterns, wherein at least one of the plurality of interlayer insulating layers is exposed to the second side surface at a part thereof positioned between adjacent two of the second electrode patterns, wherein a part of the first external terminal that is formed on the first side surface is formed on surfaces of the plurality of respective first electrode patterns exposed to the first side surface so as to avoid exposed portions of the interlayer insulating layers, and wherein a part of the second external terminal that is formed on the second side surface is formed on surfaces of the plurality of respective second electrode patterns exposed to the second side surface so as to avoid exposed portions of the interlayer insulating layers.

2. The coil component as claimed in claim 1, wherein at least one of the plurality of first via conductors is exposed to the first side surface, wherein at least one of the plurality of second via conductors is exposed to the second side surface, wherein a part of the first external terminal that is formed on the first side surface is further formed on a surface of the first via conductor exposed to the first side surface, and wherein a part of the second external terminal that is formed on the second side surface is further formed on a surface of the second via conductor exposed to the second side surface.

3. The coil component as claimed in claim 2, wherein the plurality of conductor layers include first, second, and third conductor layers which are laminated in this order in the lamination direction, wherein the plurality of first via conductors include a first connection part connecting the first electrode pattern included in the first conductor layer and the first electrode pattern included in the second conductor layer and a second connection part connecting the first electrode pattern included in the second conductor layer and the first electrode pattern included in the third conductor layer, wherein the plurality of second via conductors include a third connection part connecting the second electrode pattern included in the first conductor layer and the second electrode pattern included in the second conductor layer and a fourth connection part connecting the second electrode pattern included in the second conductor layer and the second electrode pattern included in the third conductor layer, wherein a part of the first connection part that is exposed to the first side surface and a part of the second connection part that is exposed to the first side surface do not overlap each other as viewed in the lamination direction, and wherein a part of the third connection part that is exposed to the second side surface and a part of the fourth connection part that is exposed to the second side surface do not overlap each other as viewed in the lamination direction.

4. A coil component comprising:

an element body including a magnetic member and a coil part embedded in the magnetic member, the coil part including a coil conductor pattern and a plurality of interlayer insulating layers; and an external terminal electrically connected to the coil conductor pattern, wherein the element body has a first surface including a first area, a second area, and a third area located between the first and second areas in a first direction, wherein the external terminal is formed on the first area, second area, and a part of the third area, wherein one of the interlayer insulating layers is exposed on a remaining part of the third area so that the remaining part of the third area is free from the external terminal, and wherein the first surface of the element body further includes fourth and fifth areas, wherein the first, second, and third areas are located between the fourth and fifth areas in a second direction perpendicular to the first direction, and wherein the magnetic member is exposed on the fourth and fifth areas so that the fourth and fifth areas are free from the external terminal.

5. The coil component as claimed in claim 4, wherein the first surface of the element body further includes sixth and seventh areas, wherein the seventh area is located between the second and sixth areas in the first direction and between the fourth and fifth areas in the second direction, wherein the external terminal is further formed on the sixth area and a part of the seventh area, and wherein another one of the interlayer insulating layers is exposed on a remaining part of the seventh area so that the remaining part of the seventh area is free from the external terminal.

6. The coil component as claimed in claim 5, wherein a position of the part of the third area in the second direction is different from a position of the part of the seventh area in the second direction.

7. The coil component as claimed in claim 6, wherein the position of the part of the third area in the second direction does not overlap the position of the part of the seventh area in the second direction.

8. The coil component as claimed in claim 4, wherein the remaining part of the third area is greater than the part of the third area.

9. The coil component as claimed in claim 4, wherein the external terminal is further formed on a second surface of the element body, and wherein the second surface is perpendicular to the first surface.

10. The coil component as claimed in claim 9, wherein the element body further has a third surface perpendicular to the first and second surfaces, and wherein the third surface is free from the external terminal.

11. The coil component as claimed in claim 10, wherein the plurality of interlayer insulating layers are exposed on the third surface.

12. A coil component comprising:

an element body including a magnetic member and a coil part embedded in the magnetic member, the coil part including a coil conductor pattern and a plurality of interlayer insulating layers; and an external terminal electrically connected to the coil conductor pattern, wherein the element body has a first surface including a first area, a second area, and a third area located between the first and second areas in a first direction, wherein the external terminal is formed on the first area, second area, and a part of the third area, wherein one of the interlayer insulating layers is exposed on a remaining part of the third area so that the remaining part of the third area is free from the external terminal, wherein the external terminal is further formed on a second surface of the element body, the second surface being perpendicular to the first surface, wherein the element body further has a third surface perpendicular to the first and second surfaces, the third surface being free from the external terminal, and wherein the plurality of interlayer insulating layers are exposed on the third surface.

* * * * *